US006928177B2

(12) United States Patent
Chatani et al.

(10) Patent No.: US 6,928,177 B2
(45) Date of Patent: Aug. 9, 2005

(54) SPEAKER-USE PROTECTION ELEMENT AND SPEAKER DEVICE

(75) Inventors: Ikuo Chatani, Kanagawa (JP); Yukio Yasuda, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/257,728

(22) PCT Filed: Feb. 21, 2002

(86) PCT No.: PCT/JP02/01566

§ 371 (c)(1),
(2), (4) Date: Mar. 31, 2003

(87) PCT Pub. No.: WO02/067625

PCT Pub. Date: Aug. 29, 2002

(65) Prior Publication Data

US 2003/0156728 A1 Aug. 21, 2003

(30) Foreign Application Priority Data

Feb. 21, 2001 (JP) ..... 2001-044630

(51) Int. Cl.[7] ..... H04R 25/00
(52) U.S. Cl. ..... 381/189; 381/55

(58) Field of Search ..... 381/55, 58–59, 381/111, 164, 189, 397

(56) References Cited

U.S. PATENT DOCUMENTS 4,864,624 A * 9/1989 Tichy ..... 381/55
6,647,120 B2 * 11/2003 Howze ..... 381/55

* cited by examiner

*Primary Examiner*—Suhan Ni
(74) *Attorney, Agent, or Firm*—Jay H. Maioli

(57) ABSTRACT

A loudspeaker protective unit for protecting a loudspeaker device against an excessive input current includes a lamp connected in series with the loudspeaker unit. The lamp is housed in a casing exhibiting light-sealing properties formed of an electrically conductive material, and is sealed with a sealant exhibiting a predetermined electrical conductivity. The spacing between lead lines of the lamp housed in the casing is of a preset value. An inert gas is sealed within a main lamp body unit and a preset voltage is applied to the main lamp body unit. When the voltage is applied across the lead lines, an electrical discharge is produced to interrupt the current flowing through the filament so as to prohibit a temperature rise in the lamp.

16 Claims, 4 Drawing Sheets

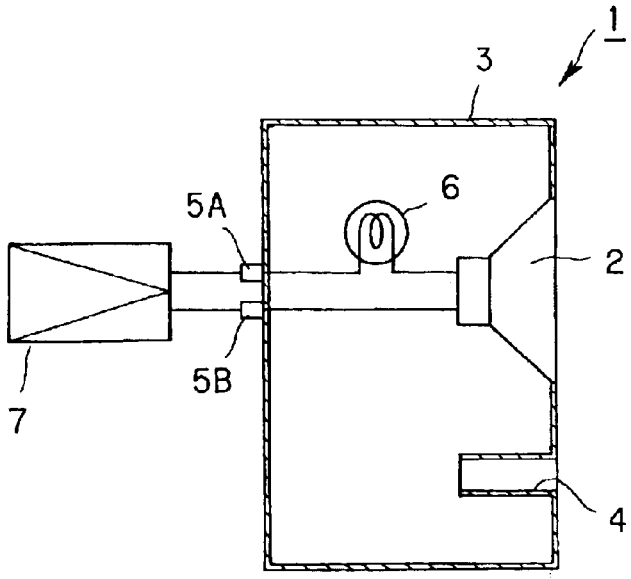
FIG. 1
FIG. 2A
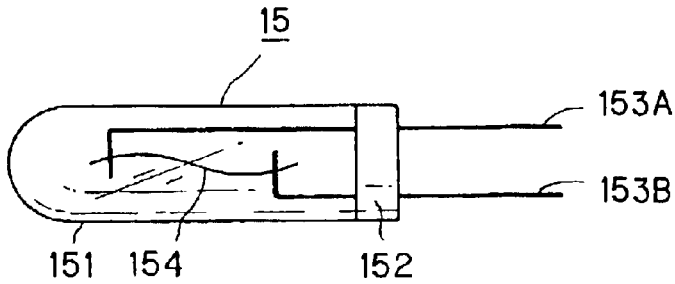
FIG. 2B
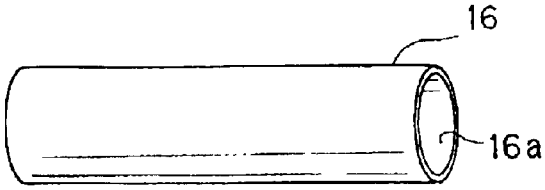
FIG. 2C
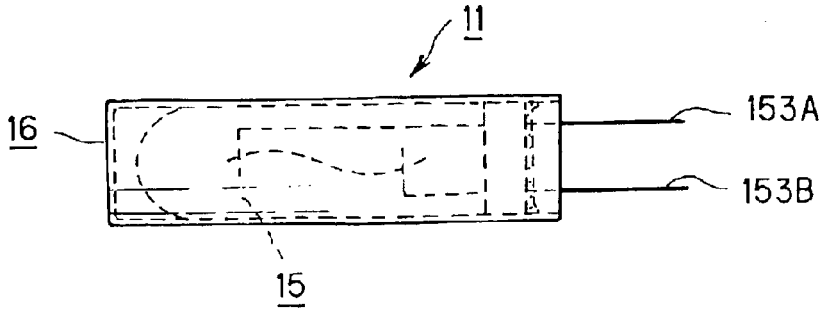

FIG. 5A
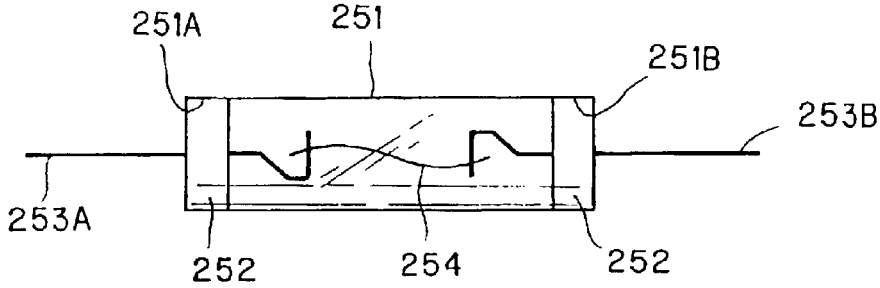
FIG. 5B
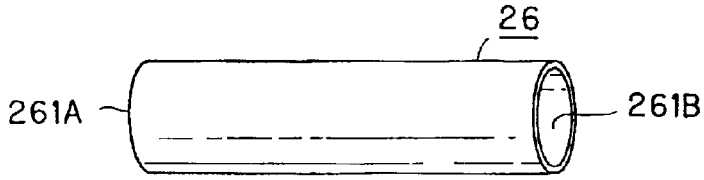
FIG. 5C
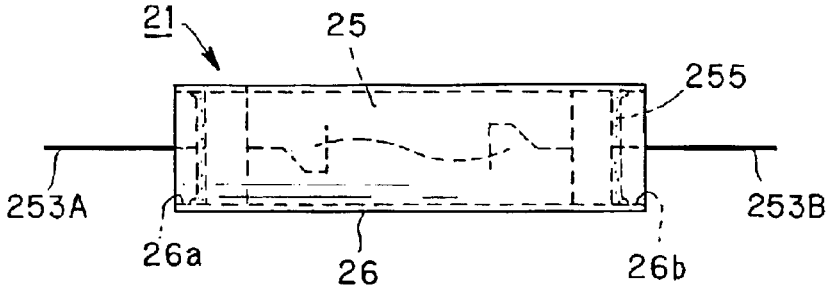
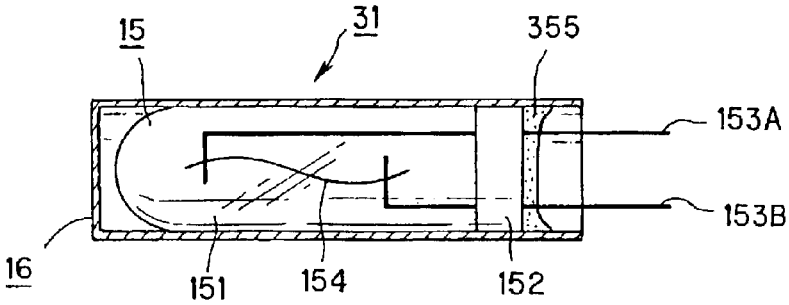
FIG. 6

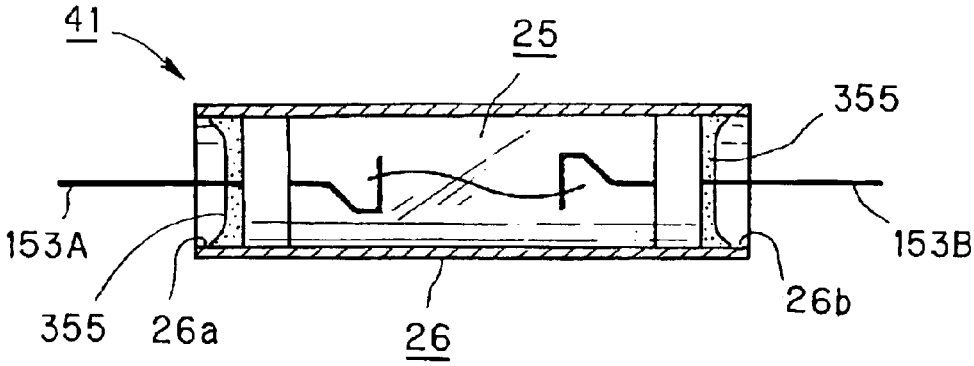
FIG. 7
FIG. 8A
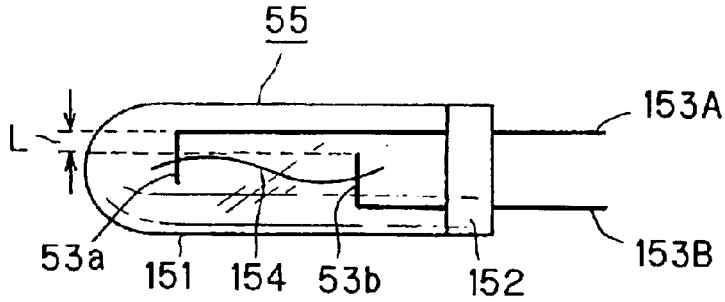
FIG. 8B
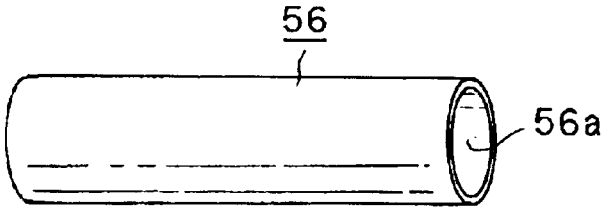
FIG. 8C
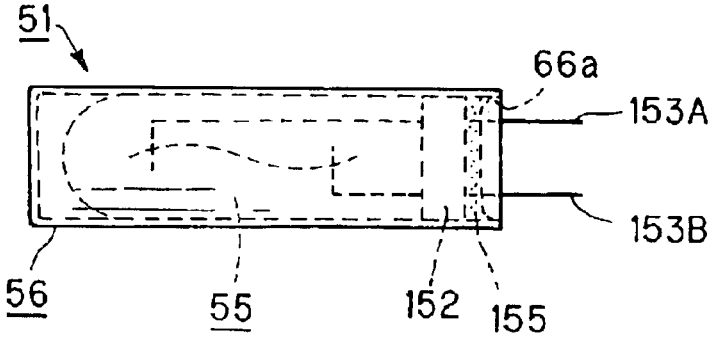

SPEAKER-USE PROTECTION ELEMENT AND SPEAKER DEVICE

TECHNICAL FIELD

This invention relates to a loudspeaker protective unit for protecting a loudspeaker device from an excessive input and to a loudspeaker device employing this protective unit

BACKGROUND ART

When the power exceeding an allowed input is continuously supplied to a loudspeaker device or to a loudspeaker unit, the temperature of the voice coil of the loudspeaker unit is excessively increased, as a result of which the voice coil skin is gradually carbonized to cause partial shorting. In this partially shorted state, an excessive current, for example, a current of several to tens of amperes, flows through the voice coil, with the consequence that the remaining normal portions of the voice coil become red-hot to cause fuming, shorting, abnormal heat evolution or line breakage. In case of excessive heat evolution, ignition may sometimes be produced. In particular, if a power amplifier of a large output is frequently used, abnormal heat evolution is increased, thus producing an extremely risky situation.

With this in mind, such a loudspeaker device 1, provided with a circuit for protecting a loudspeaker unit from an excess input state, as shown in FIG. 1, has been proposed. This loudspeaker device includes a loudspeaker unit 2 as a subject of protection against any excessive input state. The loudspeaker unit 2 is mounted to a cabinet 3. In the illustrated example of the cabinet 3, a port 4 for reflex is provided on its front surface.

The back surface of the cabinet 3 carries input terminals 5A, 5B. To one 5A of these terminals is connected the loudspeaker unit 2 via a lamp 6, such as a small-sized incandescent lamp, whereas, to the other input terminal 5B, there is directly connected the loudspeaker unit 2. A power amplifier 7 is connected to the input terminals 5A, 5B. An audio output of the power amplifier 7 is supplied via a lamp 6 to the loudspeaker unit 2. If, in this case, the output of the power amplifier 7 is only small, the signal current flowing through the lamp 6 is also small, so that the lamp 6 is not lit, with its resistance being small. Thus, the audio output of the power amplifier 7 is supplied to the loudspeaker unit 2, substantially unchanged, so that a desired acoustic output is produced.

However, if the output of the power amplifier 7 continues to be of a large value for an extended time interval, a large current continues to flow through the lamp 6, so that the lamp 6 is lit, with the resistance of the lamp being then increased. Consequently, the signal power supplied to the loudspeaker unit 2 is limited, so that the loudspeaker 2 may be protected against excess input.

Thus, the loudspeaker device 1, shown in FIG. 1, is able to protect the loudspeaker unit 2 from excess input by the lamp 6.

In the case of the loudspeaker device 1, described above, the lamp 6 is lit under a condition in which the input of an excess level is continuously supplied, with the result that the inside of the cabinet 3 becomes illuminated due to light emitted by the lamp 6, or the light may leak through a port 4, so that the user may feel disagreeable. In particular, if the loudspeaker device 1 is used in conjunction with video equipment, such light leakage is objectionable for image appreciation.

Moreover, in the above-described loudspeaker device 1, it may be an occurrence that, if part or all of the voice coil of the loudspeaker unit 2 becomes shorted due to excess input, so that its impedance is lowered, the loudspeaker unit 2 or the lamp 6, as load, does not appear to be shorted, when looking from the power amplifier 7, such that the power amplifier 7 continues to be in operation as normally. If such state persists, the output of the power amplifier 7 continuously flows into the lamp 6, with the risk that the temperature of the lamp 6 is increased excessively.

DISCLOSURE OF THE INVENTION

It is therefore an object of the present invention to provide a novel loudspeaker protective unit in which the above-mentioned problems of the conventional loudspeaker device or the loudspeaker unit may be overcome, and a novel loudspeaker device.

It is another object of the present invention to provide a novel loudspeaker protective unit and a loudspeaker device in which light leakage of a lamp used as a loudspeaker protective unit may be prevented from occurring.

It is yet another object of the present invention to provide a loudspeaker device that may be used with advantage in conjunction with video equipment.

The present invention provides a loudspeaker protective unit including a lamp connected in series with a loudspeaker unit for protecting a loudspeaker device or the loudspeaker unit from an excessive input, and a light shielding member provided around the lamp for shielding the light emanated from the lamp.

With the loudspeaker protective unit of the present invention, if the lamp is lit by excessive input, the light radiated from the light shielding casing is interrupted by a light shielding casing without illuminating the inside of the cabinet. Thus, in case of excessive input, there is no fear of the inside of the cabinet being illuminated or of light straying from a port for bus reflex to give a disagreeable feeling to the user. Moreover, if the loudspeaker protective unit is being used in conjunction with video equipment, there is no fear of light straying out to obstruct image viewing. Additionally, since the casing is formed of metal, there is no fear of lowering the lamp durability.

Another loudspeaker protective unit of the present invention includes a lamp connected in series with a loudspeaker unit for protecting the loudspeaker unit from excessive input, and a light shielding casing formed of an electrically conductive material. The lamp is housed in a light-shielding casing and is sealed with a sealant exhibiting preset electrical conductivity.

With this loudspeaker protective unit of the present invention, having the above-described structure, if a loudspeaker voice coil is shorted partially or in its entirety by excessive input, arc discharge is produced, with the casing acting as a cold cathode. This discharge interrupts the lamp current to prohibit the lamp temperature from increasing.

With the loudspeaker protective unit, if the lamp is lit by excessive input, there is no risk of light emanated from the lamp illuminating the inside of the cabinet, so that, in case of excessive input, there is no fear of the inside of the cabinet being illuminated or of light straying from the port for bus reflex to give a disagreeable feeling to the user. Moreover, if the loudspeaker protective unit is being used in conjunction with video equipment, there is no fear of light straying out to obstruct image viewing. Additionally, since the casing is formed of metal, there is no fear of lowering the lamp durability.

Still another loudspeaker protective unit of the present invention includes a lamp connected in series with a loudspeaker unit for protecting the loudspeaker unit from excessive input, and a light shielding casing housing the lamp. The lamp includes a filament, a casing for accommodating this filament, and a pair of lead lines to which is connected the filament. In this casing, the-separation between the paired lead lines is of a preset value. A preset inert gas is sealed in the vessel such that electrical discharge occurs at a preset voltage across the paired lead lines.

In a further loudspeaker protective unit of the present invention, if the voice coil of the loudspeaker unit is shorted partially or in its entirety so that excessive current flows continuously, arc discharge occurs across the lead lines to interrupt the lamp filament current to prevent the lamp temperature from increasing.

With this loudspeaker protective unit, if the lamp is lit under excessive input, there is no risk of the light from the lamp illuminating the inside of the cabinet, so that, in case of excessive input, there is no fear of the inside of the cabinet being illuminated or of light straying from the port for bus reflex to give a disagreeable feeling to the user. Moreover, if the loudspeaker protective unit is being used in conjunction with video equipment, there is no fear of light straying out to obstruct image viewing. Additionally, since the casing is formed of metal, there is no fear of lowering the lamp durability.

The present invention also provides a loudspeaker device employing the above-described loudspeaker protective unit. The loudspeaker device benefits from the advantages realized by the above-described loudspeaker protective unit.

Other objects, features and advantages of the present invention will become more apparent from reading the embodiments of the present invention as shown in the drawings.

BRIEF DESCRIPTION OF THE DRAWINGS

FIG. 1 is a cross-sectional view showing a loudspeaker device having a circuit for protection against an excessive input state.

FIG. 2A is a side view showing a lamp forming a loudspeaker protective unit according to a first embodiment of the present invention; FIG. 2B is a perspective view showing a lamp-accommodating casing; and FIG. 2C is a side view showing a loudspeaker protective unit comprised of a lamp accommodated in a casing.

FIG. 5A is a side view showing another example of a lamp constituting a loudspeaker protective unit according to the present invention; FIG. 5B is a perspective view showing a casing having a lamp accommodated therein; and FIG. 5C is a side view showing another example of a casing having a lamp accommodated therein.

FIG. 6 is a cross-sectional view showing a loudspeaker protective unit according to a second embodiment of the present invention.

FIG. 7 is a side view showing a loudspeaker protective unit, employing another example of a lamp, according to the second embodiment of the present invention.

FIG. 8A is a side view showing a lamp forming a loudspeaker protective unit according to a third embodiment of the present invention; FIG. 8B is a perspective view showing casing for accommodating a lamp therein; and FIG. 8C is a side view showing a loudspeaker protective unit comprised of a lamp accommodated n a casing.

BEST MODE FOR CARRYING OUT THE INVENTION

Figure 3:
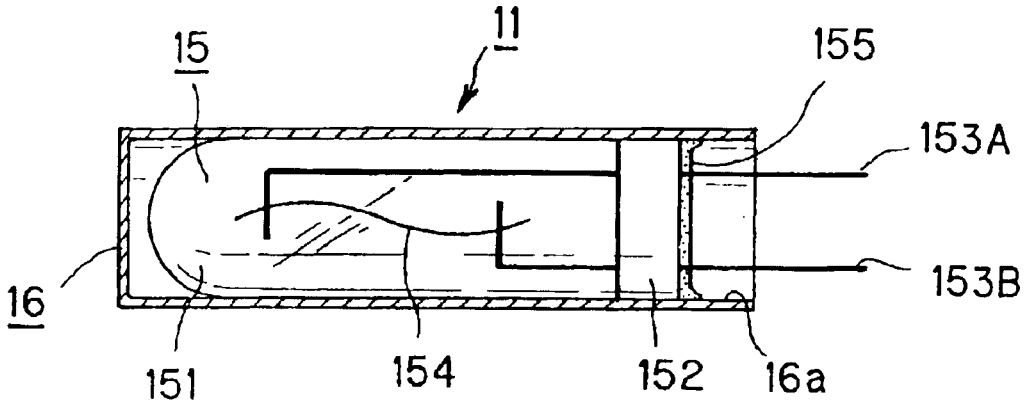
FIG. 3 is a cross-sectional view showing a loudspeaker protective unit according to the present invention.

Referring to the drawings, certain preferred embodiments of the present invention will be explained in detail.

First, a first embodiment of the present invention is explained.

A loudspeaker protective unit 11 includes a lamp 15 constructed as shown in FIG. 2A. This lamp 15 is a general-purpose commodity comprised of a main lamp body unit 151 formed to a cup shape from transparent glass. The main lamp body unit 151 has its one end opening hermetically sealed with an insulating material 152 of opaque glass or ceramics. Through this insulating material 152 are passed a pair of outlet lead lines 153A, 153B from within the main lamp body unit 151. A filament 154 is connected across the paired lead lines 153A, 153B located within the main lamp body unit 151. This filament is supplied with current and thereby lit to operate as a lamp.

The loudspeaker protective unit 11 according to the present invention includes a casing 16, shown for example in FIG. 2B, in association with the lamp 15 constructed as shown in FIG. 2A. This casing 16 is formed to a cup shape from a material exhibiting both light shielding properties and heat-radiating properties, for example, metals, such as iron, aluminum or copper. The casing 16, used here, is of an inner diameter equal to or slightly larger than the outer diameter of the lamp 15, with the length of the lamp 15 being approximately equal to or slightly larger than the length of the main lamp body unit 151. Meanwhile, only the right-side end of the casing 16 shown in FIG. 2B is opened at 16*a* to present a tubular shape.

The lamp 15 is introduced into the casing 16 via opening 16*a* with the distal end of the main lamp body unit 151 as an inserting end, as shown in FIG. 2C . The lamp 15 housed in the casing 16 and fixedly mounted in position by a light shielding adhesive 155 charged into the opening 16*a* of the casing 16, as shown in FIG. 3. The adhesive 155 is charged as hermetically sealing the opening 16*a* in such a manner as to inhibit the light of the lamp 15 from leaking to outside of the casing 16 in which the lamp is housed. The paired outlet lead lines 153A, 153B, led out from the proximal end of the main lamp body unit 151, are drawn out of the casing 16 through the adhesive 155, as shown in FIG. 3.

In the loudspeaker protective unit 11 according to the present invention in which the lamp 15 is housed within the casing 16, exhibiting light shielding properties, and in which the opening 16*a* of the casing 16 is sealed with the adhesive 155, similarly exhibiting light shielding properties, there is no risk of light from the lit lamp 15 in the casing 16 leaking to outside the casing 16.

The loudspeaker protective unit 11 according to the present invention, in which the lamp 15 is housed within the casing 16, exhibiting light shielding properties, is arranged within the loudspeaker device, constructed similarly to the above-described loudspeaker device shown in FIG. 1.

A loudspeaker device 12, within which is housed the loudspeaker protective unit 11 according to the present invention, has its basic structure in common with the structure shown in FIG. 1. Therefore, the same reference numerals are used to depict common components and the detailed description therefor is omitted for simplicity.

Figure 4:
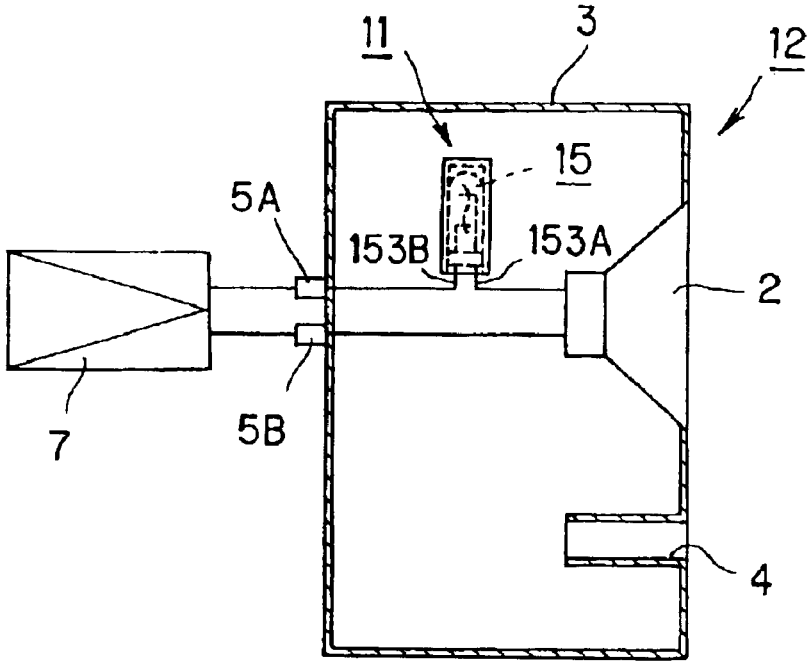
FIG. 4 is a cross-sectional view showing a loudspeaker device provided with a loudspeaker protective unit according to the present invention.

The loudspeaker protective unit 11 according to the present invention is arranged within the cabinet 3, as the lamp 15 is connected in series across the input terminal 5A and the loudspeaker unit 2, as shown in FIG. 4. The lamp 15 is connected in series across the input terminal 5A and the loudspeaker 2 via paired lead lines 153A, 153B.

When the above-described loudspeaker protective unit 11, according to the present invention, is mounted within the loudspeaker device 12, and an input of an excess level is continuously applied via input terminal 5A, the lamp 15 is lit. That is, if the large output state of the power amplifier 7 is sustained, the state of a large signal current flowing through the lamp 15 is sustained. As a consequence, the lamp 15 is lit, while its resistance is increased to limit the signal power supplied to the loudspeaker unit 2 to protect the loudspeaker unit 2 against excess input.

Meanwhile, in the loudspeaker protective unit 11 of the present invention, in which the light of the lit lamp 15, is shielded by the casing 16 and by the adhesive 155 sealing the opening 16*a* of the casing 16, there is no risk of the light from the lamp 15 leaking to the inside of the cabinet 3, or illuminating the inside of the cabinet 3. With the use of the loudspeaker protective unit 11 of the present invention, there is no danger of the inside of the cabinet 3 of the loudspeaker device 12 becoming luminous or of the light leaking from the port 4 to give a disagreeable feeling to a user even under an excessive input state.

If the loudspeaker device 12, employing the loudspeaker protective unit 11 according to the present invention, is used in conjunction with video equipment, there is no risk of light leaking to prove a nuisance to picture viewing. Moreover, since the casing 16 is formed of a material exhibiting high thermal conductivity, such as metals, for example, iron, aluminum or copper, heat radiation from the lamp 15 is not obstructed, and hence the lamp 15 is not lowered in durability.

The lamp forming the loudspeaker protective unit, according to the present invention, is not limited to the above-described structure in which the paired outlet lead lines 153A, 153B are drawn out from the proximal side of the main lamp body unit 151, and may also be constructed as shown in FIG. 5A. A lamp 25, shown in FIG. 5A, includes a main lamp body unit 251. From both ends of the main lamp body unit 251 are drawn out lead lines 253A, 253*b*.

In a lamp 25, shown in FIG. 5A, openings 251A, 251B on both ends of a main lamp body unit 251, from which are drawn out the lead lines 253A, 253B, are hermetically sealed with an insulating material 252, such as opaque glass or ceramics. The proximal ends of the lead lines 253A, 253B are passed through the insulating material 152, hermetically sealing the openings 251A, 251B of the main lamp body unit 251, to outside the main lamp body unit 251. A filament 254 is connected across the ends of the paired lead lines 253A, 253B located within the main lamp body unit 251. This lamp 25 also operates as a lamp, and is lit by the current flowing in the filament 254.

A casing 26, in which to accommodate the lamp 25, from both ends of the main body unit 251 of which have been drawn out the lead lines 253A, 253B, is formed to the shape of a cylinder having its both ends opened, as shown in FIG. 5B. This casing 26, similarly to the above-mentioned casing, is formed of a material exhibiting light shielding and heat radiating properties, such as metals, for example iron, aluminum or copper.

The casing 26 is formed to accommodate a cylindrically-shaped lamp 25 therein, as shown in FIG. 5C, and has an inner diameter approximately equal to or slightly larger than the outer profile of the lamp 25 enclosed therein, and a length approximately equal to or slightly larger than the length of the main lamp body unit 251.

The present instance of the loudspeaker protective unit 21 is formed by accommodating the lamp 25 in the casing, with the main lamp body unit 251 located within the casing 26, and by charging a light-shielding adhesive 255 in both openings 26*a*, 26*b* in both end portions of the casing 26, from which the lead lines 253A, 253B have been drawn out, for sealing, as shown in FIG. 5C.

The above-described loudspeaker protective unit 21, similarly to the loudspeaker protective unit 11, described above, is connected in series across the input terminal 5A and the loudspeaker unit 2, in such a manner that, when an excess input state has occurred in the loudspeaker device 12, the lamp 25 is lit. With the present loudspeaker protective unit 21, there is no risk of leakage of light emitted from the lit lamp 15 to outside the casing 26 to prevent the inside of the cabinet 3 from being illuminated as well as to prevent the light from leaking via port 4 to outside the cabinet 3, thus avoiding giving a disagreeable feeling to the user. If the loudspeaker device 12, employing the loudspeaker protective unit 21, is used in conjunction with video equipment, there is no risk of light leaking to prove a nuisance to picture viewing.

Since the inner peripheral surface of the casings 16, 26, forming the protective units for the loudspeakers 11, 21, may be of the glossy metal color, or processed to a blackish color, in such a manner as to control the temperature when the lamps 15, 25 are lit, so that it is possible to modify the durability of the lamps 15, 25 or protective characteristics for the loudspeaker unit. For example, the inner peripheral surface of the casings 16, 26 may be processed with blackish color to ameliorate durability of the lamps 15, 25. In addition, a large number of heat-dissipating fins (heat sinks) may be formed on the outer peripheral surface of the casings 16, 26 for further improving the durability of the lamps 15, 25.

In the above-described the protective units for the loudspeakers 11, 21, the lamps 15, 25 are accommodated in the casings 16, 26 exhibiting light shielding properties. Alternatively, ceramics layers may be formed, such as by coating, on the surface of the lamps 15, 25 to develop the light shielding performance. Although the ceramics used here are inferior in thermal conductivity, the ceramic layer applied on coating on the surfaces of the lamps 15, 25 may be reduced in thickness to prevent heat dissipating characteristics or durability of the lamps 15, 25 from being lowered.

A second embodiment of the present invention is now explained.

A loudspeaker protective unit 31 of the second embodiment of the invention uses the lamp 15 and the casing 16, used in the above-described first embodiment shown in FIGS. 2A and 2B. As for the structure of the lamp 15 and the casing 16, reference may be had to the foregoing explanation in order to avoid redundancy.

In the present embodiment, the lamp 15 is introduced through the opening 16*a* into the casing 16, with the distal end of the main lamp body unit 151 as an inserting end, as shown in FIG. 2C. A sealant 355, exhibiting moderate electrical conductivity, is charged for sealing into the opening 16*a* of the casing 16, housing the lamp 15, as shown in FIG. 6. By charging the sealant 355 in the opening 16*a* of the casing 16, the lamp 15, housed within the casing 16, is secured in the casing 16 as the paired lead lines 153A, 153*b* are drawn to outside the casing 16.

Referring to FIG. 6, the lamp 15 is introduced into the casing 16, and covered with a piece of an insulating material 152, provided on the proximal end of the lamp 15, and the sealant 355 is then charged into the opening 16*a* up to the inner wall of the casing 16 to seal the opening 16*a*.

The sealant 355 used here may be a mixture with carbon powders of e.g., silicon bond or ceramic bond. Even though the adhesive forming the sealant 355 is not electrically conductive, the carbon powders mixed into this adhesive are electrically conductive, so that electrical conductivity may be afforded to the sealant 355 by adjusting the proportion (amount of addition) of the carbon powders to the adhesive.

With the use of the electrically conductive sealant 355, the electrical resistance across the lead lines 153A, 153B, led out from the lamp 15 accommodated in this casing 16, and the casing 16, may be set to a magnitude on the order of for example 500 kΩ. This resistance value can be suitably adjusted by adjusting the amount of carbon powders mixed into the adhesive. For example, the resistance value of the sealant 355 may be lowered by increasing the amount of carbon powders mixed to the adhesive.

Similarly to the loudspeaker protective unit 11, described above, the loudspeaker protective unit 31, arranged as shown in FIG. 6, is mounted within the cabinet 3, with the lamp 15 connected in series across the input terminal 5A and the loudspeaker 2. The lamp 15 is connected in series across the input terminal 5A and the loudspeaker 2 with interposition of the paired lead lines 153A, 153B.

Our experiments have revealed that, with the loudspeaker protective unit 31 of the present embodiment, arc discharge occurs across the lead lines 153A, 153B within the lamp 15, when a voltage value associated with the electrical conductivity of the sealant 355, used for sealing the opening 16*a* of the casing 16, is reached, as the voltage applied to the lamp 15 is increased. It has been confirmed that such arc discharge occurs both in case one of the paired lead lines 153A, 153B exhibits preset electrical conductivity with respect to the casing 16 and in case both of the paired lead lines 153A, 153B exhibit preset electrical conductivity with respect to the casing 16. Even if both of the paired lead lines 153A, 153B exhibit preset electrical conductivity with respect to the casing 16, the electrical resistance is only of the order of hundreds of kΩ, as described above, which is appreciably larger than the resistance value of the inner filament 154 in the lamp 15, so that the operation is not affected with the ordinary input level operation.

It has also been confirmed that, by changing the material of the casing 16, by allowing the inner peripheral surface of the casing 16 to remain in the state of a glossy metal surface, or by processing the inner peripheral surface to a blackish color, the arc discharge voltage is changed. The present inventors have found that the discharge voltage in case the casing 16 is of aluminum is lower than in case it is formed of bronze, and that the discharge voltage when the inner peripheral surface of the casing 16 is processed to a blackish color is higher than otherwise, even though the material of the casing is the same.

The present inventors also have conducted experiments on a sealant formed only of an adhesive, such as silicon bond or ceramic bond, not containing carbon powders, thus not exhibiting electrical conductivity. It has been confirmed that, in this case, the discharge voltage becomes,lower than in case sealing is not applied. This phenomenon may be accounted for as follows: Part of light radiated from a filament 154 of the lamp 15 leaks to outside through the insulating material 152 of the lamp 15 or through a gap between the lamp 15 and the casing 16. It may be presumed that, by sealing the opening 16*a* of the casing 16, housing the lamp 15, the light is confined within the interior of the casing 16, at the same time as the heat evolved is confined within the inferior of the casing 16 or of the main lamp body unit 151, and hence the internal temperature of the lamp 15 tends to be increased, thus lowering the voltage at which occurs the arc discharge.

Similarly to the loudspeaker protective unit 11, described above, the loudspeaker protective unit 31 is connected in series across the input terminal 5A and the loudspeaker unit 2. By continuously supplying an input of an excess level to the loudspeaker unit 2, mounted to the loudspeaker device 12, the casing 16 operates as a cold cathode to induce arc discharge in case the voice coil of the loudspeaker unit 2 is shorted partially or in its entirety, with the impedance value of the voice coil then being lowered. Due to the occurrence of the arc discharge, the signal current flowing through a filament 154 of the lamp 15 is interrupted to prevent the lam temperature from increasing.

With the loudspeaker device, fitted with the loudspeaker protective unit 31 according to the present invention, if the arc discharge voltage is set so as to be equal to the signal voltage at the time of excess input, the lamp 15 is broken due to arc discharge at the time of excess input, so that excessive heat evolution in the non-shorted portion of the voice coil of the loudspeaker unit 2 or the lamp 15 may be prevented from occurring.

Moreover, if, when the lamp 15 of the loudspeaker protective unit 31 is performing the protective operation for the loudspeaker unit 2 as normally, the input state to the loudspeaker unit 2 is increased, the lamp 15 is lit, however, the light emanating from the lamp 15 is shielded by the casing 16, without illuminating the inside of the cabinet 3. As a consequence, if the input state to the loudspeaker unit 2 is excessive, there is no risk of the interior of the cabinet 3 from becoming luminous or of the light leaking from the port 4 to give a disagreeable feeling to the user. Even if a loudspeaker device employing the loudspeaker protective unit 31 is being used in conjunction with video equipment, there is no risk of light leaking to prove a nuisance to picture viewing.

By forming the casing 16 of metal, in the present loudspeaker protective unit 31, heat evolved from the lamp 15 housed therein may be efficiently dissipated, so that the lamp 156 is not deteriorated in durability.

The lamp forming the loudspeaker protective unit in the present embodiment is not limited to such a one in which the paired lead lines 153A, 153B are drawn out from the proximal end of the main lamp body unit 151 as described above, but such a one may be used in which paired lead lines 253A, 253B are drawn out form both ends of the cylindrically-shaped main lamp body unit 251, formed of transparent glass and opened at both ends, as shown in FIG. 5A.

With the loudspeaker protective unit 41 of the present instance, the lamp 25 is housed within the casing 26 so that the main lamp body unit 251 will be located in the casing 26, as shown in FIG. 7. In both end openings 26*a*, 26*b* of the casing 26, including the lamp 25, housed therein, the sealant 355, exhibiting electrical conductivity, is charged. With the sealant 355 charged into the openings 26*a*, 26*b* of the casing 26, the lamp 25, housed in the casing 26, is immobilized in the casing 16, as the paired lead lines 153A, 153B are pulled out of the casing 16, as shown in FIG. 7.

Similarly to the loudspeaker protective unit 31, described above, the loudspeaker protective unit 41, shown in FIG. 7, is connected in series across the input terminal 5A and the loudspeaker 2, and is arranged in this state in the loudspeaker device 12. The loudspeaker device 12, employing this loudspeaker protective unit 41, performs an operation similar to that performed by the loudspeaker device 12 employing the loudspeaker protective unit 31 to give rise to comparable merits.

A third embodiment of the present invention is now explained.

A loudspeaker protective unit 51 of the third embodiment of the present invention uses a lamp and a casing similar in structure to the lamp 15 and the casing 16, shown in FIGS. 2A and 2B, respectively, as used in the aforementioned first embodiment, or uses a lamp and a casing similar in structure to the lamp 25 and the casing 26, shown in FIGS. 5A and 5B, respectively.

An embodiment employing a lamp and a casing similar in structure to the lamp 15 and the casing 16, shown in FIGS. 2A and 2B, is now explained It should be noted that parts or components similar to the lamp 15 and the casing 16 shown in FIGS. 2A and 2B are indicated by corresponding reference numerals and the detailed description therefor is omitted for simplicity.

A lamp 55, forming a loudspeaker protective unit 51 according to the third embodiment, includes a main lamp body unit 151, formed of transparent glass to a cup shape, as shown in FIG. 8A. The main lamp body unit 151 has its one end opening 151 hermetically sealed with a piece of insulating material 152, such as opaque glass or ceramics. Within the inside of the main lamp body unit 151, hermetically sealed by the piece of insulating material 152, there is enclosed an inert gas, such as neon, argon, cryptone or xenon.

From the main lamp body unit 151, having an inert gas sealed therein, paired lead lines 153A, 153B are drawn out through the piece of insulating material 152. These lead lines 153A, 153B are extended through the piece of insulating material 152 in the same direction parallel to each other, as shown in FIG. 8A. The portions of these lead lines 153A, 153B disposed in the main lamp body unit 151, are of different lengths. That is, the lead lines 153A, 153B have respective ends 53*a*, 53*b* lying within the main lamp body unit 151 bent at right angles in directions approaching to each other, and a filament 154 is connected across these ends 53*a*, 53*b*. It should be noted that the narrowest length L between the lead lines 153A and 153B within the inside of the main lamp body unit 151 is of a preset value.

The lamp 55, shown in FIG. 8A, is housed within the casing 56, configured as shown in FIG. 8B, and forms a loudspeaker protective unit 51. Similarly to the above-mentioned casing, the casing 51, used here, is formed to a cup shape from a material having light shielding and heat dissipating properties, such as, for example, iron, aluminum or copper.

The lamp 55 is introduced into via opening 56*a* into the casing 56, with the distal end of the main lamp body unit 151 as an inserting end, as shown in FIG. 8C. The lamp 55, housed within the casing 56, is immobilized within the inside of the casing 56, by a light shielding adhesive charged into an opening 56*a* of the casing 56. The adhesive 155 is charged so as to hermetically seal the opening 56*a*, such as not to permit the light of the lamp 55 housed within the casing 56 to leak outside the casing 56. The paired lead lines 153A, 153B, drawn out at the proximal ends of the main lamp body unit 151, are passed through the adhesive 155 and drawn to outside of the casing 56, as shown in FIG. 8C.

Similarly to the aforementioned protective units for the loudspeaker, such as the loudspeaker protective unit 11, the loudspeaker protective unit 51 is housed in the loudspeaker device 12, as the loudspeaker protective unit is connected in series across the input terminal 5A and the loudspeaker unit 2. The lamp 55 is connected in series across the input terminal 5A and the loudspeaker unit 2 via paired lead lines 153A, 153B.

If, in the loudspeaker device 12, fitted with the loudspeaker protective unit 51, an input of an excessive level occurs in the loudspeaker unit 2, such that the voice coil in the loudspeaker unit 2 is partially shorted, arc discharge occurs across the paired lead lines 153A, 153B within the inside of the main lamp body unit 151 of the lamp 55. Due to this arc discharge, the current through the filament 154 of the lamp 55 is shut down to inhibit the temperature of the lamp 55 from being raised.

Meanwhile, our experiments have revealed that the voltage at which arc discharge is initiated across the lead lines 153A, 153B can be set to a required value in dependence upon the length L and on the sorts of the inert gas sealed into the main lamp body unit 151. The discharge voltage in case of sealing an inert gas is higher in case the narrowest length L between the lead lines 153A, 153B in the inside of the main lamp body unit 151 is made constant than if the inside of the lamp is vacuum. Moreover, if the types of the insert gases to be sealed, such as neon, argon, cryptone or xenon, are changed, the discharge start voltage becomes relatively lower in this sequence. The smaller the length L between the lead lines 153A, 153B, the lower may be the discharge start voltage.

Additionally, when the lamp 55 is performing the operation of protecting the loudspeaker unit 2 as regularly, the lamp 6 is lit for a larger input state. However, the lamp 55 is housed in the casing 56, so that light from it is shielded and hence the light emanated from the lamp 55 does not illuminate the inside of the cabinet 3. As a consequence, even if the input state to the loudspeaker unit 2 is excessive, there is no risk of the interior of the cabinet 3 from becoming luminous or of the light leaking from the port 4 to give a disagreeable feeling to the user. Even if a loudspeaker device employing the loudspeaker protective unit 51 is being used in conjunction with video equipment, there is no risk of light leaking to prove a nuisance to picture viewing.

Meanwhile, with the loudspeaker protective unit 51 of the present embodiment, the inner peripheral surface of the casing 56 may retain the glossy metal color, or processed to a blackish color, such as to control the temperature when the lamp 55 is lit, so that it is possible to change the durability of the lamp 55 or protective characteristics for the loudspeaker unit. Our experiments have revealed that, by forming the casing 56 of aluminum, forming an oxide film on the inner peripheral surface to provide a blackish or red color, or to provide a gold color on addition of a paint, it is possible to change the discharge initialing voltage or lamp durability. This phenomenon can be understood in such a manner that, since the light emanating from the filament is reflected by the inner peripheral surface of the casing 56 and again absorbed by the filament to raise its temperature, the discharge initialing voltage or lamp durability is changed by for example the light reflectance or absorption on the inner peripheral surface of the casing 56 or heat dissipation to outside the casing. The inert gas, sealed in the main lamp body unit 151, may also be a mixture of plural inert gases.

If an electrically conductive sealant is used for sealing the casing 56 of the lamp 55, the casing 56 operates as a cold cathode when the voice coil of the loudspeaker unit 2 is shorted partially or in its entirety due to excessive input, to produce arc discharge, which arc discharge in turn interrupts the current flowing through the lamp 55 to inhibit the temperature rise in the lamp 55.

In the above-described embodiment, the lamp 55 is housed within the casing 56. Alternatively, a ceramic layer may be formed, such as by painting, on the surface of the lamp 55 to develop light shielding properties. Although ceramics used are inferior in thermal conductivity, the ceramic layer provided to the surface of the lamp 55 may be reduced in thickness, in which case there may be no danger of the heat dissipating characteristics of the lamp 55 being deteriorated or of the durability of the lamp 55 being lowered.

It is of course possible to combine the above-described various embodiments in an optional fashion.

Industrial Applicability

According to the present invention, described above, the loudspeaker protecting lamp is loaded in a casing having light shielding properties, there is no fear of the light emanated from the lamp due to excessive input illuminating the inside of the cabinet or of the light leaking from the port for bus reflex to give a disagreeable feeling to the user. By forming the lamp accommodating casing of metal, there is no risk of the lamp durability being lowered.

According to the present invention, in which the sealant exhibiting suitable electrical conductivity is used for sealing the space between the lamp lead wires and the casing exhibiting light shielding properties, the casing operates as a cold cathode in case of an excessive input to produce arc discharge to inhibit temperature increase of the lamp. By adjusting the electrical connectivity of the sealant, the voltage at which occurs the discharge may be adjusted to a value corresponding to the allowable input voltage to the loudspeaker unit to be protected.

Moreover, since an inert gas is sealed within the lamp, electrical discharge may be produced at a preset voltage across the paired lead lines of the lamp in case of an excessive input to interrupt the current through the filament to prohibit the lamp temperature from increasing. Thus, with the loudspeaker device according to the present invention, the lamp temperature can be prevented from being increased at the time of excessive input.

What is claimed is:

1. A loudspeaker protective unit comprising:

a lamp having a pair of lead lines and being connected in series with a loudspeaker unit for protecting said loudspeaker unit from an excessive input current;

a tubular metal light shielding member provided around said lamp for shielding light emanated from said lamp; and a light-shielding adhesive having said lead lines passing therethrough for sealing said lamp inside tubular metal light shielding member.

2. The loudspeaker protective unit according to claim 1, wherein an inner peripheral surface of said light shielding member is processed to a blackish color.

3. A loudspeaker protective unit comprising:

a lamp having a pair of lead lines and connected in series to a loudspeaker unit for protecting said loudspeaker unit from an excessive input current;

a casing provided around said lamp, said casing being formed of an electrically conductive material and having light shielding properties; and a light-shielding adhesive forming a seal across at least one of the pair of lead lines of said lamp and said light shielding casing.

4. The loudspeaker protective unit according to claim 3 wherein said light-shielding adhesive is electrically conductive and exhibits a predetermined electrical conductivity.

5. The loudspeaker protective unit according to claim 4 wherein said light-shielding adhesive is admixed with carbon powders.

6. The loudspeaker protective unit according to claim 3 wherein said light shielding casing is a metal casing formed as one of cup-shaped and cylindrically-shaped for conforming to a shape of the lamp.

7. The loudspeaker protective unit according to claim 3 wherein an inner peripheral surface of said casing is processed to a blackish color.

8. The loudspeaker protective unit according to claim 6 wherein an inner peripheral surface of said casing is processed to a blackish color.

9. A loudspeaker protective unit comprising:

a lamp connected in series with a loudspeaker unit for protecting said loudspeaker unit from an excessive input current, said lamp having a filament, a main lamp body unit housing said filament, and a pair of lead lines to which said filament is connected;

an inert gas being sealed in said main lamp body unit; said pair of lead lines being arranged at a predetermined spacing from each other in said main lamp body unit;

a tubular metal casing formed around said lamp for shielding light emanating from said lamp; and a light-shielding adhesive having said pair of lead lines passing therethrough for sealing said lamp in said tubular metal casing.

10. The loudspeaker protective unit according to claim 9 wherein said inert gas is a neon gas or an argon gas.

11. The loudspeaker protective unit according to claim 9 wherein said inert gas is cryptone gas or xenon gas.

12. The loudspeaker protective unit according to claim 9 wherein said inert gas is a mixture of a plurality of different inert gases.

13. The loudspeaker protective unit according to claim 9 wherein said light-shielding adhesive exhibits electrical conductivity.

14. A loudspeaker device comprising:

a loudspeaker unit arranged in a cabinet;

a lamp having a pair of lead lines and being connected in series to said loudspeaker unit and arranged in the cabinet for protecting said loudspeaker unit from an excessive input current, said lamp including a light shielding member provided therearound, for shielding light radiated from said lamp;

a tubular metal casing formed around said lamp for shielding light emanating from said lamp; and a light-shielding adhesive having said pair of lead lines passing therethrough for sealing said lamp in said tubular metal casing.

15. A loudspeaker device comprising:

a loudspeaker unit arranged in a cabinet; and a lamp including a pair of lead lines, said lamp being connected in series with said loudspeaker unit and arranged in the cabinet for protecting said loudspeaker unit against excessive input current;

a light-shielding casing provided said lamp, said light-shielding casing being formed of an electrically conductive material and having light-shielding properties, wherein at least one of said pair of lead lines of said lamp and said light-shielding casing being sealed from each other with a light-shielding sealant that seals said lamp inside said light-shielding casing.

16. A loudspeaker device comprising:

a loudspeaker unit; and a lamp connected in series with said loudspeaker unit for protecting said loudspeaker unit from excessive input current said lamp having a filament, a main lamp body unit housing said filament, and a pair of lead lines to which said filament is connected;

a tubular metal light-shielding casing provided around said lamp for shielding light radiated from said lamp;

an inert gas being sealed in said main lamp body unit and said pair of lead lines being arranged at a predetermined spacing from each other in said main lamp body unit, so that one of said pair of lead lines is spaced apart from said tubular metal light-shielding casing to cause said casing to form a cold cathode in an over-voltage situation.

* * * * *